United States Patent [19]

Weber et al.

[11] 4,132,754

[45] Jan. 2, 1979

[54] RINSING MULTI COMPONENT FOAM MACHINES

[75] Inventors: Kurt Weber, Rimbach, Odw.; Michael Brehm, Weinheim, both of Germany

[73] Assignee: Firma Carl Freudenberg, Weinheim, Germany

[21] Appl. No.: 767,923

[22] Filed: Feb. 11, 1977

[30] Foreign Application Priority Data

Feb. 14, 1976 [DE] Fed. Rep. of Germany ..... 2605984

[51] Int. Cl.[2] ..... B08B 3/08; B08B 9/08

[52] U.S. Cl. ..... 264/39; 134/2; 134/22 R; 134/23; 252/548; 264/51

[58] Field of Search ..... 252/548; 260/635 R, 260/635 C; 264/39, 5, 51; 134/2, 22 R, 23

[56] References Cited

U.S. PATENT DOCUMENTS

| | | | |
|---|---|---|---|
| 2,759,024 | 8/1956 | Kasehagen et al. | 260/635 C X |
| 2,901,311 | 8/1959 | Nusslein et al. | 260/635 R X |
| 3,329,729 | 7/1967 | Brandner et al. | 260/635 C |
| 3,691,135 | 9/1972 | Schulze et al. | 260/635 R X |
| 3,691,135 | 9/1972 | Schulze et al. | 260/77.5 AP |
| 3,814,780 | 6/1974 | Woodhall | 264/39 X |
| 3,832,427 | 8/1974 | Mutch | 264/39 |
| 3,849,074 | 11/1974 | Ficklinger et al. | 134/23 X |
| 3,965,228 | 6/1976 | Vreenegoor | 264/39 |
| 4,056,403 | 11/1977 | Cramer et al. | 134/22 R |
| 4,070,425 | 1/1978 | Wood | 134/22 R X |
| 4,073,664 | 2/1978 | Zwirlein | 134/22 R X |

FOREIGN PATENT DOCUMENTS

| | | | |
|---|---|---|---|
| 72964 | 5/1970 | German Democratic Rep. | 134/2 |

*Primary Examiner*—Philip Anderson

*Attorney, Agent, or Firm*—Sprung, Felfe, Horn, Lynch & Kramer

[57] ABSTRACT

In the production of a polyurethane foam by supplying two or more components to a machine, mixing said components, extruding the mixture to form a foaming mass, subsequently discontinuing supply and extrusion, rinsing the machine, and subsequently resuming supply and extrusion, the improvement which comprises effecting said rinsing with a rinsing agent having the approximate weight composition Water: 70-80 parts Sorbitol: 25-18 parts Emulsifier: 5-2 parts

5 Claims, No Drawings

RINSING MULTI COMPONENT FOAM MACHINES

This invention deals with a rinsing agent for multi-component foam machines with mixer heads and stirring chambers.

Normally, foam machines are used for producing quick-hardening sythetic resin foam in multi-component systems through which the substances necessary to produce the final product are processed via mixer heads. Especially during the synthesis of polyurethane or unsaturated polyester resins, these mixer heads tend to become clogged and, therefore, should be thoroughly flushed periodically or whenever necessary with appropriate rinsing agents. The stirring chambers connected to the mixer heads must also be automatically flushed with a rinsing agent after each run.

Normally volatile organic solvents such as methylene chloride, trichloroethylene, acetone, methyl ethylketone, dimethyl sulfoxide or dimethyl formamide are used as rinsing agents. Remnants of the volatile rinsing agents become completely evaporated by insufflation.

Such volatile solvents are ideally used for flushing purposes since the rinsing agent, being pressurized during its performance, is totally squeezed out of the mixer heads and stirring chamber, becoming extremely vaporous when finally insufflated. The solvents employed are extremely aggressive and toxic and may even present a fire hazard, e.g., when using acetone. The disadvantages are tolerated as only the aforementioned solvents are capable of dissolving and totally eliminating synthetic resins often most difficult to remove.

There is no danger of fire involved if trichloroethylene or methylene chloride is used; however, such substances are extremely toxic and also exert a high degree of wear and tear on the packing and machine parts. Hence, attempts were previously made to apply pure water or to use a water-based solvent. However, using solvents of this type could, in many instances, result in damage, since various residues could impede the mixing mechanism of the chamber and the mixer heads owing to the fact that the components used to produce the synthetic resin foam would no longer be homogeneous when mixed. Thus, water-based rinsing agents, although representing vast improvement with regard to toxicity and flammability, have only limited capability.

This invention assumes the primary task of developing a non-toxic, non-flammable rinsing agent for multi-component foam machines with mixer heads and stirring mechanisms, ensuring unimpaired reaction cycling. When used, it will not exert undue wear and tear on the machine parts or packing nor deposit residue in the mixer heads or stirring chambers. Based on economic and ecological considerations, the rinsing agent should be produced with a water base.

A rinsing agent for multi-component foam machines with mixer heads and stirring chambers has now been provided comprising an aqueous solution of a polyhydric alcohol, containing a slight quantity of an appropriate saponaceous active oil in water emulsifier.

The rinsing agent as per this invention is especially suited for producing polyurethane foam. At the outset of the reaction stage, the raw materials dissolve completely in the water-solution in the form of an emulsion. The highly reactive isocyanate is transformed into compounds which are physiologically harmless and which can be evacuated into the wast water without causing any harm. There is no danger of the packing or machine parts becoming corroded, and a smooth, unimpaired functioning of the unit while in operation is thus assured.

The rinsing is recommended especially with regard to polyurethane systems (soft, semi-hard, hard, integral), and may be used with equal success in producing polyesters or other synthetic resins and synthetic resin foams, using two or more components. As a polyhydric alcohol, sorbitol is highly suitable together with a mixture of triethanolamine and olein as a saponaceous active oil in a water emulsifier. For this purpose, a mixture is recommended, comprised of the following proportions according to weight: approximately 70–80 water with 25–18 sorbitol and 5–2 oil-in-water emulsifier. The ratio of the properties may, if need be, vary in dependence upon the previous reaction rate of the mixture to be flushed and may also be altered to accommodate a specific operation. Thus, when producing polyurethane, a rinsing agent is recommended which would be composed of the following proportions according to weight apprcximately 75 water, 22 sorbitol and 3 emulsifier.

As a polyhydric alcohol, the following are suitable ethylene glycol, glycerine, butanediol, dipropylene glycol, tripropylene glycol, high molecular polyethylene glycol, and the like.

Suitable saponaceous oil-in-water emulsifiers obtainable on the market are for example the products Emulan$^{(R)}$ and Lutensol$^{(R)}$ sold by the firm BASF, Comperlant or Texapon A, Texapon JES and Texapon MLS sold by the firm Henkel, Sulfetal KT400 or Sulfetal Cjot 60 sold by the firm Zschimmer und Schwarz, Oberlahnstein, all of West Germany; however, equivalent products of other manufacturers are also acceptable.

It will be appreciated that the instant specification and examples are set forth by way of illustration and not limitation, and that various modifications and changes may be made without departing from the spirit and scope of the present invention.

What is claimed is:

1. The process of rinsing a double component foam machine which comprises contacting the interior parts of said machine with a rinsing agent consisting essentially of an aqueous emulsion of a polyhydric alcohol and a small amount of a saponaceous active oil-in-water emulsifier.

2. The process according to claim 1, wherein the aqueous emulsion has the approximate weight composition Water: 70-80 parts
Sorbitol: 25-18 parts
Emulsifier: 5-2 parts 3. The process according to claim 1, wherein prior to and after rinsing a polyurethane foam is produced with the machine by supplying at least two components to the machine, mixing said components, discharging the mixture to form a foaming mass, and subsequently discontinuing supply and discharge.

4. The process according to claim 3, wherein the aqueous emulsion has the approximate weight composition Water: 70-80 parts
Sorbitol: 25-18 parts
Emulsifier: 5-18 parts 5. The process according to claim 4, wherein the emulsifier comprises triethanolamine plus olein.

* * * * *